United States Patent [19]

Enoki et al.

[11] Patent Number: 4,733,267

[45] Date of Patent: Mar. 22, 1988

[54] APPARATUS FOR DEVELOPING ELECTROSTATIC LATENT IMAGE

[75] Inventors: Shigekazu Enoki, Kasawaki; Noriyuki Kimura, Kawasaki; Shunji Katoh, Sagamihara, all of Japan

[73] Assignee: Ricoh Company, Ltd., Tokyo, Japan

[21] Appl. No.: 39,168

[22] Filed: Apr. 17, 1987

[30] Foreign Application Priority Data

| | | | |
|---|---|---|---|
| Apr. 18, 1986 | [JP] | Japan | 61-090687 |
| Jul. 7, 1986 | [JP] | Japan | 61-159199 |
| Oct. 20, 1986 | [JP] | Japan | 61-249300 |

[51] Int. Cl.[4] ..... G03G 15/09

[52] U.S. Cl. ..... 355/3 DD; 355/14 D

[58] Field of Search ..... 355/3 DD, 14 D, 3 TR, 355/14 TR, 15; 118/656, 657

[56] References Cited

U.S. PATENT DOCUMENTS

| | | | |
|---|---|---|---|
| 3,900,002 | 8/1975 | Stange | 355/3 DD X |
| 4,351,604 | 9/1982 | Karasawa et al. | 355/3 DD X |
| 4,357,097 | 11/1982 | Koiso | 355/3 DD X |
| 4,370,049 | 1/1983 | Kuge et al. | 355/3 DD |
| 4,377,334 | 3/1983 | Nishikawa | 355/3 DD |
| 4,385,829 | 5/1983 | Nakahata et al. | 355/3 DD |

*Primary Examiner*—A. C. Prescott

*Attorney, Agent, or Firm*—Oblon, Fisher, Spivak, McClelland & Maier

[57] ABSTRACT

A two-component toner is directly supplied to a brush which is cyclically transferred while in resilient contact with a latent image carrier for developing an electrostatic latent image on the latent image carrier. After the image has been developed by the toner, residual toner is directly recovered from the brush for uniformizing the toner density on the brush.

5 Claims, 14 Drawing Figures

APPARATUS FOR DEVELOPING ELECTROSTATIC LATENT IMAGE

BACKGROUND OF THE INVENTION

The present invention relates to an apparatus for developing an electrostatic latent image with a dry-type two-component developer while stabilizing the density of the developed image at all times.

FIG. 8 of the accompanying drawings illustrates an image developing apparatus which is generally employed for carrying out a method of developing an electrostatic latent image using a dry-type two-component developer. The image developing device includes a large toner tank 1 housing various agitating mechanisms such as an agitating roller 2, a feed screw 3, and an agitating separator 4. Toner which has been supplied from a toner hopper 5 is mixed with a carrier and agitated by these agitating mechanisms, and then delivered onto a developing roller 6 serving as a developer carrier, on which the toner is deposited as a magnetic brush layer. The thickness of the deposited developer or magnetic brush layer is limited by a doctor blade 7.

The developing roller 6 includes a sleeve 8 with a pluraltity of magnets 9 disposed therein. At least one of the sleeve 8 and the magnet assembly is rotated in one direction to move the magnetic brush on the circumferential surface of the sleeve 8 in a certain direction. The magnetic brush is brought into contact with a photosensitive body 10 to develop an electrostatic latent image thereon into a visible toner image. After the image has been developed, the magnetic brush is scraped off the developing roller 6 into the toner tank 1. The toner that has fallen into the toner tank 1 is agitated and mixed again by the agitating mechanisms.

The two-component developer is required to be well agitated and mixed for uniform toner density or good toner charging. The conventional apparatus for developing electrostatic latent images using the two-component developer are advantageous in that developed images are of stable quality. However, the various agitating mechanisms are necessary for sufficiently agitating the developer, and a large space is required for defining an agitating passage in which the developer is agitated by those agitating mechanisms. Another problem is that the carrier of the developer is fatigued by the agitation of the developer, resulting in a reduction of carrier durability.

In order to eliminate the drawbacks of the image developing apparatus using the two-component developer, there have been proposed various image developing apparatus in which the developer is not mixed and agitated. One such image developing apparatus is of the self-balanced type as disclosed in U.S. Pat. No. 4,615,606 and includes a charging roller for depositing toner thereon, the charging roller contacting a magnetic brush to supply toner. In another image developing apparatus, a magnetic brush is employed to supply toner to a developing roller for forming a thin toner layer on the developing roller. The former image developing apparatus is however problematic in that the toner on the developing roller has irregular densities because uniform balancing forces cannot be obtained due to irregular charged amounts among toner particles and irregular toner particle diameters. With the latter apparatus, the developer is still required to be well mixed and agitated.

The applicant has filed patent applications on a hybrid-type developing apparatus employing a dry-type two-component developer as a one-component developer (see U.S. patent application No. 016,739, U.K. Patent Application No. 8703853, West German Patent Application No. P3705496.4, and French Patent Application No. 8702278). In this hybrid-type developing apparatus, a resilient brush means such as a magnetic brush or a fur brush on a sleeve is held in contact with a photosensitive drum as a latent carrier, and an image developing region is defined in the area where the magnetic brush contacts the photosensitive drum. A toner supply roller as a toner supply means is disposed in contact with the magnetic brush upstream of the image developing region in the direction of movement of the magnetic brush, and a toner recovery roller as a toner recovery means is located downstream of the image developing region.

The hybrid-type developing apparauts operates as follows: Toner stored in a toner hopper is supplied by the toner supply roller as it is rotated, while being triboelectrically charged thereby, as a thin uniform layer to the magnetic brush under a given toner supplying bias voltage. The magnetic brush to which toner has been supplied is transferred toward the photosensitive drum to develope an electrostatic latent image formed on the drum. After the image has been developed, the magnetic brush has toner density differences or irregularities in pattern corresponding to the image. The residual toner on the magnetic brush is transferred to and recovered by the toner recovery roller under a toner recovering electric bias. According to the arrangements disclosed in U.S. Pat. Nos. 4,347,299 and 4,230,070, a toner recovering bias voltage commensurate with the density of an original, i.e., a toner recovering bias voltage corresponding to a toner consumption, is applied to keep a constant toner supply at all times. In the hybrid-type developing apparatus, however, toner is recovered until the toner density of the magnetic brush is uniformized, irrespective of how toner may be consumed. The toner density differences in the surface layer of the magnetic brush which contributes to image development are thus eliminated to make the toner density uniform. More specifically, after the toner recovery, the magnetic brush contains only the carrier or has a uniform toner density distribution, and is moved away from the toner recovery roller toward the toner supply roller.

In the hybrid-type developing apparatus, the carrier of the developer is not required to be scraped off the sleeve or continues to move on the sleeve at all times. It has been found, however, that in case an ordinary carrier is used as the magnetic brush carrier, carrier particles tend to move progressively toward the opposite ends of the sleeve where the carrier particles are collected at a high density, with the result that the carrier is localized and images will not be developed uniformly.

Such carrier particle localization is caused in the following manner: As shwn in FIG. 9, the sleeve 12 is rotatable with a sleeve shaft 12*a* made of a nonmagnetic material such as aluminum and houses therein a development magnetic roller 13 having one end rotatably coupled to a bearing 13*a* supported on the shaft 12*a* and the opposite end fixed to a a side plate. As indicated by I in FIG. 9, the radial distribution of magnetic flux densities produced on the sleeve 12 by the development magnetic roller 13 is progressively increased from a magnet end and becomes constant beyond about 5 mm from the magnet end. At a magnet end, lines of magnetic force are directed rather axially than radially as indicated by II since the distance between opposite poles is small. As a result, the formed magnetic brush is radially erected at the central area of the development magnetic roller 13 whereas it is directed or inclined axially along the lines of magnetic force at each of the magnet ends.

The magnetic brush at each end of the development magnetic brush 13 is of a common configuration among almost all magnetic rollers. By substantially reducing the distance between magnetic poles through a reduction in the diameter of the development magnetic roller or an increase in the number of magnetic poles, the axial components of the lines of magnetic force are prevented from being increased, and the generation of inclined magnetic brush elements is reduced (it is impossible, in principle, to direct all of the lines of magnetic force radially at each end of a magnetic roller with magnets located inside a sleeve).

A development magnetic roller having a diameter of about 20 mm and alternate 6 to 8 magnetic poles of different polarities still suffers inclined magnetic brush components at each roller end. Therefore, the distance between magnetic poles appears relatively large with such a roller diameter and number of magnetic poles.

Attempts to reduce the pole-to-pole distance would invite a reduction in the magnetic forces of the magnets themselves, thus incapable of retaining carrier particles on the sleeve which would fail to function as a development magnetic roller. One conventional solution has been to seal the ends of the sleeve 12 with resilient members and utilize only the central portion of the magnet.

Where an ordinary carrier is used as the magnetic brush carrier, carrier particles are apt to be scattered away upon rotation of the sleeve 12. The amount of the scattered carrier is increased as the rotational speed of the sleeve 12 goes higher, and is determined by the balancing between magnetically attractive forces and centrifugal forces acting on the carrier particles.

Another problem with an ordinary carrier used as the magnetic brush carrier is that carrier particles do not substantially move between the surface and lower layers of the magnetic brush formed on the sleeve 12. Carrier particles near the sleeve surface are of a high carrier particle density and are prevented from moving by surrounding carrier particles even when the magnetic field to which they are subjected is varied. On the other hand, those carrier particles wich are present near the ends of the magnetic brush are relatively freely movable because of a lower particle density, and can consequently be moved as the magnetic field changes. Due to such different carrier particle behaviors, any exchange of carrier particles between the surface and lower layers of the magnetic brush is highly improbable to occur. Therefore, toner deposited on the surface of the sleeve which serves as support for the magnetic brush would not be removed. An electrically insulative toner layer is thus deposited in covering relation to the surface of the sleeve, changing the electric characteristics thereof. As a consequence, the quality of reproduced images or printed images is impaired.

General image developing apparatus have a means for detecting the remaining amount of toner in a toner hopper. Such a detecting means comprises a mechanical detector disposed in a driver mechanism 32 (FIG. 10) for a toner supply roller 31 as shown in FIG. 8.

More specifically, when there is toner in the toner hopper 5, an agitator gear 33 is rotated by a driving gear 34 to supply toner. A detector flange 36 is integral with an agitator 35 (FIG. 8) in the toner hopper 5, and its rotation is delayed from the agitator gear 33 since the agitator 35 is loaded by the toner in the honner hopper 5. Therefore, a recess **36*a* defined in the detector flange 36 and a recess 37*a* defined in a cam 37 integral with the agitator gear 33 are positioned out of alignment with each other, as shown in FIGS. 11**(*a*) and 11(b). As a result, a detecting arm 39 of a toner shortage sensor 38 is not operated and no toner shortage signal is generated.

When the agitator 35 is turned until it is released form the toner load, the detector flange 36 is pulled by a spring 40 acting between the detector flange 36 and the agitator gear 33, and is turned until the recesses **36*a*, 37*a* are alinged with each other. Insofar as the toner hopper 5 contains toner, therefore, the detector 36 and the cam 37** repeat the above operation.

In case the toner hopper 5 runs out of toner, the agitator 35 is no longer loaded, and the agitator 35 rotates with the agitator gear 33. The recesses **36*a*, 37*a* thus remain aligned under the force of the spring 40. The detecting end 39*a* of the detecting arm 39 is brought into the recesses 36*a*, 37*a* to cause the toner shortage sensor 38 to produce a toner shortage signal, as illustrated in FIGS. 12**(*a*) and 12(*b*).

The conventional image developing apparatus having such a toner shortage detecting means is complex in construction. In addition, the toner shortage detecting means may fail to operate properly because the relationship between the remaining amount of toner in the toner hopper and the toner load on the agitator is liable to fluctuate.

SUMMARY OF THE INVENTION

It is an object of the present invention to provide an apparatus for developing an electrostatic latent image through a hybrid arrangement in which a two-component developer that is not required to be agitated is employed thereby to dispense with various agitating mechanisms and an agitating space, the apparatus size is largely reduced, the two-component developer can be handled in the same manner as a one-component developer, the carrier of the two-component developer is prevented from being quickly fatigued, image stability and flexibility achieved by the two-component developer are retained, carrier particles constituting a magnetic brush are prevented from being localized and scattered out, and toner is uniformly dispersed in the magnetic brush for stable continued image developing operation.

Another object of the present invention is to provide an apparatus for developing an electrostatic latent image through a hybrid arrangement in which toner shortage in a toner hopper can reliably be detected through a simple structure.

According to the present invention, there is provided an apparatus for developing an electrostatic latent image, comprising a magnetic brush for holding toner and resiliently contacting a latent image carrier in an image developing region to supply the toner to an electrostatic latent image formed on the latent image carrier, toner supply means for supplying charged toner to the magnetic brush in a toner supplying region, and toner recovery means for recovering residual toner from the magnetic brush in a toner recovering region after the image has been developed by the toner, the magnetic brush being composed of a magnetically coherent carrier of particles.

According to the present invention, there is also provided an apparatus for developing an electrostatic latent image, comprising resilient developing brush means for holding toner and resiliently contacting a latent image carrier in an image developing region to supply the toner to an electrostatic latent image formed on the latent image carrier, toner supply means for supplying charged toner to the resilient developing brush means in a toner supplying region, toner recovery means for recovering residual toner from the resilient developing brush means in a toner recovering region after the image has been developed by the toner, detector means for detecting the amount of toner recovered by the toner recovery means to issue a toner signal, and toner shortage detecting means for detecting a toner shortage in a toner tank to issue a toner shortage signal based on the toner signal from the detector means.

The above and other objects, features and advantages of the present invention will become more apparent from the following description when taken in conjunction with the accompanying drawings in which preferred embodiments of the present invention are shown by way of illustrative example.

DETAILED DESCRIPTION

Figure 1:
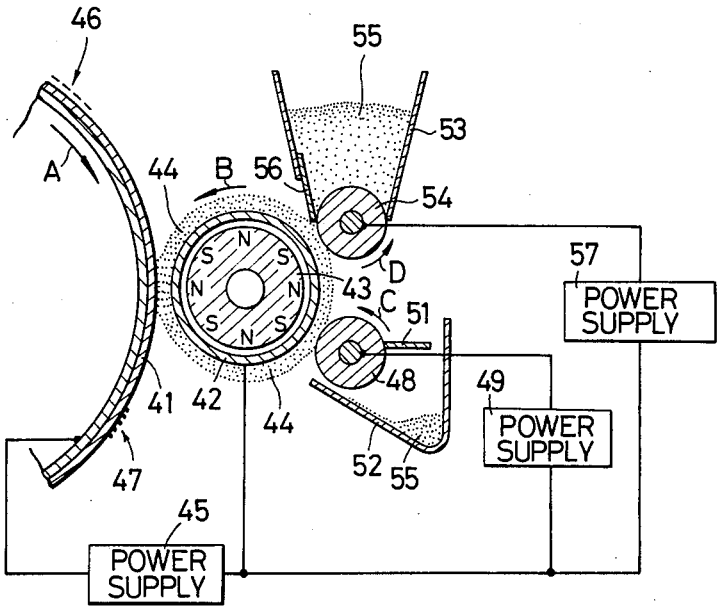
FIG. 1 is a vertical cross-sectional view of an image developing apparatus according to an embodiment of the present invention.

Like or corresponding parts are denoted by like or corresponding reference numerals throughout several views.

As shown in FIG. 1, a photosensitive drum or latent image carrier 41 is rotatable about its own axis in the direction of the arrow A by a driving mechanism (not shown). A cylindrical sleeve 42 made of a nonmagnetic material such as aluminum is disposed near the photosensitive drum 41. The cylindrical sleeve 42 houses therein a development magnetic roller 43 with a plurality of alternately different magnetic poles, the magnetic roller 43 being radially inwardly spaced from the inner circumferential surface of the sleeve 42. The magnetic roller 43 produces magnetic forces for producing a magnetic brush 44 on the sleeve 42, which is moved in the direction of the arrow B when at least one of the cylindrical sleeve 42 and the magnetic roller 43 is rotated.

The magnetic brush 44 is composed of a carrier comprising carrier particles which are magnetically attracted together under residual magnetism of the carrier itself. The carrier is of such a nature that the carrier particles will be attracted to each other upon removal of a magnetic field having a magnetic force ranging from 600 to 1000 gausses which an ordinary development magnetic roller would have after the carrier has been exposed to such a magnetic field. The carrier may have been naturally magnetized before exposure to a magnetic field. In the present embodiment, the carrier used is magnetically coherent and exhibits residual magnetism of 2 emu/g or more when it has been exposed to a magnetic field of 1,000 oersted.

The carrier may be of iron or an iron alloy such as stainless steel or a ferrite material used for permanent magnets, for example. These carrier materials are used as particles which should be of an average particle diameter ranging from 30 to 200 micrometers, preferably from 50 to 150 micrometers. The carrier particles may be coated with any of various resin materials for the control of toner charging.

A bias voltage of the same polarity as that of a latent image for developing the latent image is applied by a power supply circuit 45 to the cylindrical sleeve 42. The polarity of the bias voltage applied to the sleeve 42 remains the same irrespective of whether negative-to-positive (normal) or positive-to-positive (reversal) image development is carried out. The magnetic brush 44 on the cylindrical sleeve 42 is moved in contact with the photosensitive drum 41 to apply toner to an electrostatic latent image 46 formed on the drum 41 for thereby developing the latent image 46 into a visible image 47.

In the embodiment of FIG. 1, the cylindrical sleeve 42 has an outside diameter of 25 mm, and the development magnetic roller 43 is capable of producing magnetic forces on the outer circumferential surface of the cylindrical sleeve 42 at a magnetic flux density of about 800 gausses. The magnetic brush 44 generated has a height ranging from 0.3 to 5 mm, and preferably from 0.7 to 2 mm.

The image developing bias voltage is applied to prevent unwanted toner deposits on the background of a copy and also to adjust the density of an image on the copy. Where the potential of the latent image is −800 V and normal image development is desired, it is preferable that a developing bias voltage in the range of from 0 to −500 V be applied. For reversal image development, negatively chargeable toner should be employed, and the developing bias voltage should range from −200 to −800 V. The final developing bias voltage is determined in view of the density of a document to be copied or as the user wishes.

A toner recovery roller 48 is disposed laterally and downwardly of the cylindrical sleeve 42 for recovering residual toner from the magnetic brush 44 after the image on the photosensitive drum 41 has been developed. The toner recovery roller 48 is positioned in contact with the magnetic brush 44. A bias voltage for recovering toner is applied by a power supply circuit 49 to the toner recovery roller 48, the toner recovering bias voltage being of the polarity opposite to that of charged toner. The toner recovering bias voltage serves to recover toner remaining on the magnetic brush 44, and is of the same level as the developing potential, i.e., of such a level that it would be able to develop an entire latent image on the toner recovery roller 48 if the roller 48 were a latent image carrier. If the latent image potential is −800 V and the image developing bias voltage is −200 V, for example, then the toner recovering bias voltage may be about −600 V.

It is not necessary to recover the entire toner contained in the magnetic brush 44, but it suffices to selectively recover toner in the vicinity of the surface of the magnetic brush 44. The toner recovery is effected at least to remove toner density irregularities on the magnetic brush 44 which have been caused by the image development. For example, different toner densities on the magnetic brush 44 resulting from different toner consumption rates in black, halftone, and background areas are equalized by the toner recovery roller 48.

Generally, toner of a two-component developer is applied in an amount ranging from 0.8 to 1.0 mg per unit area. Toner is supplied to the latent image 46 while the photosensitive drum 41 and the magnetic brush 44 are relatively rotating at a speed ratio of about 1:3. Therefore, the magnetic brush 44 is only capable of supplying toner in the range of 0.27 to 0.33 mg per unit area. By recovering remaining toner at a rate exceeding the toner supplying capability of the magnetic brush 44, the toner densities on the magnetic brush 44 can be uniformized thereby to cancel out adverse effects given by the image development.

More specifically, a general two-component developer has a bulk specific gravity of 2 and a toner density of 3%. With such a two-component developer used, the weight of a magnetic brush having a height of 1 mm is 0.2 g per 1 $cm^2$. Since the weight of toner contained in that mass of magnetic brush is 6 mg, the toner which actually contributes to image development is only 5% of the magnetic brush. Stated otherwise, it only suffices to recover toner corresponding to that 5%. Differences in toner consumption by the magnetic brush can effectively be eliminated inasmuch as toner at a density of about 0.3 $mg/cm^2$ is localized in the vicinity of the surface of the magnetic brush by a toner supply roller (described below).

The toner recovery roller 48 is driven to rotate about its own axis in the direction of the arrow C for preventing recovered toner from being applied again to the magnetic brush 44. The toner recovery roller 48 is combined with a scraper blade 51 and a toner receiver tray 52. The recovered toner is scraped off the toner recovery roller 48 by the scraper blade 51 into the toner receiver tray 52, and then delivered back into a toner hopper 53.

A toner supply roller 54 is disposed laterally and upwardly of the cylindrical sleeve 42 in contact with the magnetic brush 44. The toner supply roller 54 has an upper half located in the toner hopper 53 and is driven to rotate about its own axis in the direction of the arrow D by means of a driver mechanism (not shown). As the toner supply roller 54 is rotated, toner 55 stored in the toner hopper 53 is supplied to the magnetic brush 44 past the toner supply roller 54. The toner supply roller 54 is also capable of limiting the heights of erected brush fibers of the magnetic brush 44 to a uniform level for eliminating image density irregularities.

Figure 2:
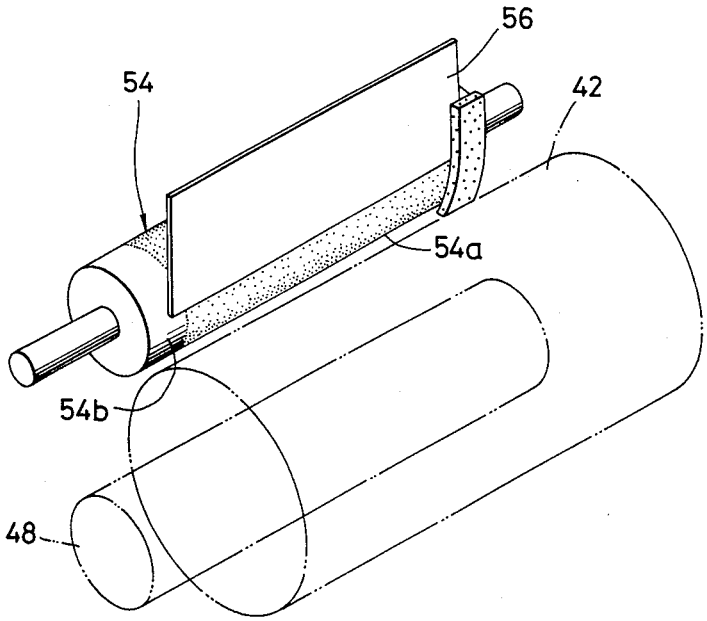
FIG. 2 is a perspective view of a toner supply roller.

As illustrated in FIG. 2, the toner supply roller 54 has a prescribed length and includes a toner carrier portion 54a in the form of an irregular surface on a central outer surface thereof. The toner supply roller 54 also has on opposite ends thereof a pair of toner seal portions **54*b* in the form of smooth mirror surfaces positioned adjacent to the toner carrier portion. Thus, toner particles are retained on the irregular surface of the toner carrier portion 54*a* and no toner particles are retained on the toner seal portions 54*b***.

The surface roughness $R_Z$ of the toner carrier portion **54*a* should be in the range of 3 to 3 microns, and preferably in the range of 5 to 15 microns. The surface roughness $R^Z$ of the toner seal portions 24*b*** should be 5 microns or below, and preferably 3 microns or below.

Since the toner supply roller 54 has irregular and mirror surfaces, it should be made of a material having high hardness. Where it is metal, it may be aluminum or its alloy, stainless steel, or brass. The toner supply roller 54 may be a metal roller coated with a syntheric resin layer, or may be formed entirely of synthetic resin.

A toner layer limiting blade 56 is attached to the toner hopper 53 in the lower opening in which the toner supply roller 54 is disposed. The toner layer limiting blade 56 has a tip edge pressed against the toner supply roller 54 across both the toner carrier portion **54*a* and the toner seal portions 54*b* for applying a uniform thin layer of toner 55 to the toner carrier portion 54*a* of the toner supply roller 54 while at the same time triboelectrically charging the toner 55. At the same time, toner particles are scraped off the toner seal portions 54*b* by the toner layer limiting blade 56. Thus, the toner 55 stored in the toner hopper 53 is transferred as a thin layer onto the magnetic brush 44** without leakage.

Another blade or roller (not shown) may also be disposed closely to the sleeve 42 between the toner supply roller 54 and the photosensitive drum 41 for uniformizing the heights of the erected brush fibers of the magnetic brush 44.

To the toner supply roller 54, there is applied a toner supplying bias voltage by a power supply circuit 57 for efficiently transferring the toner 55 to the magnetic brush 44. The toner supplying bias voltage is of the same polarity as that of the charged toner and ranges from about 0 to 600 V. In order that the toner can reliably be retained on the toner supply roller 54, a toner supply bias voltage of the polarity opposite to that of the charged toner is applied. In such a case, it is better to make the toner supply bias voltage lower than the image developing bias voltage. Assuming that the voltages to be impressed on the sleeve 42, the recovery roller 48, and the supply roller 54 are indicated respectively by $V_B$, $V_R$, $V_D$, it is preferable that the following relationship:

$$|V_B| \geqq |V_D|$$

be met for well-balanced toner supply to and recovery from the sleeve 42. Moreover, the following relationship should preferably be met:

$$|V_B| - |V_D| \geqq |V_R| - |V_B|$$

for more uniform toner density on the sleeve 42.

The toner recovery roller 48 and the toner supply roller 54 may be made of metal, electrically conductive rubber, or the like insofar as an electric bias can be applied between these rollers and the cylindrical sleeve 42. The rollers 48, 54 are disposed in contact with the magnetic brush 44 in a position ranging from 50% to 100% of the height of the magnetic brush 44. The rollers 48, 54 may however be disposed in a position exceeding 100% of the height of the magnetic brush 44 provided that the absolute value of an air gap is 1 mm or smaller, with the addition of an electric biasing means. While the outside diameters of the rollers 48, 54 may be selected as desired, they should be 80% or smaller of the outside diameter of the cylindrical sleeve 42 or in the range of from 5 to 60 mm or preferably from 8 to 40 mm. Since the amount of toner supplied to the magnetic brush 44 can be determined by the relative speed between the magnetic brush 44 and the toner supply roller 54, the amount of toner to be supplied may be controlled by varying the rotational speed of the toner supply roller 54. More specifically, the toner density may be detected by a known sensor, so that the rotational speed of the toner supply roller 54 can be controlled. Such a known sensor for detecting the toner density may be a means for detecting the reflected density of toner on the toner recovery roller 48 and calculating the toner density from the detected reflected toner density.

The toner layer limiting blade 56 may be disposed in pressed contact with the surface of the toner supply roller 54 which is diametrically opposite to the illustrated surface (FIG. 1). In such a modification, the toner supply roller 54 is rotated in the direction opposite to the direction of the arrow D.

The hybrid-type image developing apparatus of the above construction operates as follows: The toner 55 in the toner hopper 53 is retained on the toner carrier portion 54*a* at the center of the toner supply roller 54 upon rotation thereof. The retained toner is triboelectrically charged while it is being fed as a thin uniform layer by the toner layer limiting blade 56. Since the toner seal portions 54b at the opposite ends of the toner supply roller 54 have mirror surfaces, no toner particles are attached to the toner seal portions 54b. Even if any toner particles are attached to the toner seal portions 54*b*, they are scraped off from the toner seal portions 54*b* by the toner layer limiting blade 56. The toner supply roller 54 is thus sealed.

The toner is supplied as a thin uniform layer to the magnetic brush 44 under a prescribed toner supplying bias voltage. Then, the magnetic brush 44 supplied with the toner is moved toward the photosensitive drum 41 for developing an electrostatic latent image 46 formed on the photosensitive drum 41.

Irrespective of the fact that the development magnetic roller 43 has a localized distribution of lines of magnetic force at each end of the sleeve 42, no inclined magnetic brush components are generated, and as soft magnetic brush as that at the center of the development magnetic roller 43 is kept at all times at each end of the sleeve 42. This is because the carrier forming the magnetic brush exhibits a magnetically coherent property itself. Where the carrier particles form a magnetic brush on the sleeve 42, the magnetic brush acts as a magnet particularly at an end of the magnetic roller, so that forces are produced which tend to prevent the carrier particles from being directed along the lines of magnetic force produced by the development magnetic roller 43. Another reason is that since each of the carrier particles is one magnet, the carrier particles change their position (rotate, for example) as the magnetic field varies due to rotation of the sleeve 42, and are attraced under reactive forces toward the center of the roller 43 where the magnetic field is stronger.

The carrier particles are magnetized themselves and hence magnetically attracted to the development magnetic roller 43 at all times. Therefore, the carrier particles are not scattered out regardless of centrifugal forces of the sleeve 42, but remain retained in the magnetic brush 44. Since each of the carrier particles strongly reacts to a change in the magnetic field, it rotates about its own axis highly actively. As a result, the toner particles supplied to the surface layer of the magnetic brush 44 are well brought into contact with the carrier particles and dispersed substantially uniformly in all of the layers of the magnetic brush 44, resulting in good image development.

After the image has been developed, there are toner density irregularities left on the magnetic brush 44 which correspond to the image. The remaining toner on the magnetic brush 44 is tranferred to and recovered by the toner recovery roller 48 under a prescribed electric toner recovery bias. In U.S. Pat. Nos. 4,347,299 and 4,230,070, a toner recovery bias voltage commensurate with the density of an original document, i.e., toner consumption, is applied to keep the amount of supplied toner constant at all times. According to the present invention, however, toner is recovered until the toner density of the magnetic brush 44 is uniformized irrespective of the consumption of toner.

The toner density irregularities on the magnetic brush 44 are thus eliminated, and the toner density on the magnetic brush 44 is uniformized. More specifically, the magnetic brush 44 after toner recovery contains a carrier only or has a uniform toner density distribution, and is moved away from the toner recover roller 48 toward the toner supply roller 54.

The toner supplying bias voltage applied by the power supply circuit 57 is controlled on the basis of the image developing bias voltage given by the power supply circuit 45. Thus, a new amount of toner commensurate with the amount of toner which has been consumed by image development is supplied to the magnetic brush 44. The consumed amount of toner and the supplied amount of toner are therefore balanced thereby to eliminate an excessive toner supply or a toner shortage.

Figure 3:
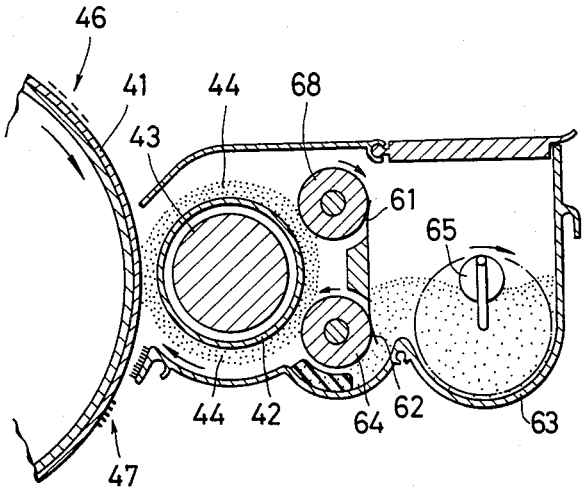
FIGS. 3, 4, and 5 are vertical cross-sectional views of image developing apparatus according to other embodiments of the present invention.

FIG. 3 shows another embodiment in which a toner scraper blade 61 and a toner layer limiting blade 62 are pressed respectively against a toner recovery roller 68 and a toner supply roller 64, respectively. Toner is scraped off the toner recovery roller 68 by the toner scraper blade 61 and received in a toner tank 63 for efficient reuse.

For example, the carrier in the magnetic brush 44 was made of 50 g of SUS 430 and used in the form of particles having an average diameter of 100 micrometers with residual magnetism (Br) of 3.14 emu/g (manufactured by Nippon Yakin). As a result, good magnetic brush characteristics were obtained as described below. The 6-pole development magnetic roller 43 capable of producing magnetic forces of 900 gausses on the surface of the sleeve 42 was fixed, and the sleeve 42 having a diameter of 20 mm was rotated clockwise at a speed of 344 rpm. The toner recovery roller 68 was in the form of a stainless steel roller having a diameter of 12 mm and rotated clockwise at a speed of 344 rpm at a spacing of 1 mm from the sleeve 42. The toner supply roller 64 was in the form of a stainless steel roller having a diameter of 16 mm and a surface roughness ($R_Z$) of 10 micrometers. The toner supply roller 64 was spaced 1 mm from the sleeve 42 and rotated clockwise at 859 rpm. Bias voltages of −600 V and −50 V are applied respectively to the toner recovery roller 68 and the toner supply roller 64. The toner used was type 2000 blue toner manufactured by Ricoh Co., Ltd.

When the image developing apparatus was operated for 10 minutes under the above conditions, carrier particles were not substantially localized at each of the opposite ends of the sleeve 42 unlike an image developing apparatus in which a general ferrite carrier (Br=1 emu/g or below) was used in a magnetic brush. The reason for this is believed to arise from the fact that since the magnetic brush serves as one magnet at each end of the magnetic roller, the magnetic brush is subjected to forces preventing itself from being directed along the lines of magnetic force produced by the development magnetic roller 43. Any scattering-out of the carrier was reduced to a large extent. As described above, the carrier particles forming the magnetic brush 44 are magnetized themselves and hence are magnetically attracted to the development magnetic roller 43 at all times. The carrier particles therefor remain retained in the magnetic brush 44 against centrifugal forces tending to scatter the carrier particles. General carrier particles would be scattered out because magnetically attractive forces or retaining forces may temporarily be eliminated between magnetic poles.

The toner in the magnetic brush 44 was dispersed substantially uniformly from upper to lower layers of the magnetic brush 44 for the reason that the magnetized carrier particles strongly reacted to a change in the magnetic field and rotate about their own axes highly actively into good contact with the toner particles. This is largely different from a magnetic brush using a general carrier in which toner is not substantially dispersed into the lower layer of the magnetic brush. When the carrier particles and the toner particles are held in increased contact with each other, the toner can be charged stably and at a high speed.

An agitator 65 is disposed in the toner tank 63 for prevent toner blocking which tends to be caused when a large amount of toner is supplied to the toner tank 63, for thereby increasing the stability of a developed image. Toner scraped off the toner recovery roller 68 by the toner scraper blade 61 should be directed in the vicinity of the agitator 65 for mixing the recovered toner and newly supplied toner highly efficiently.

Figure 4:
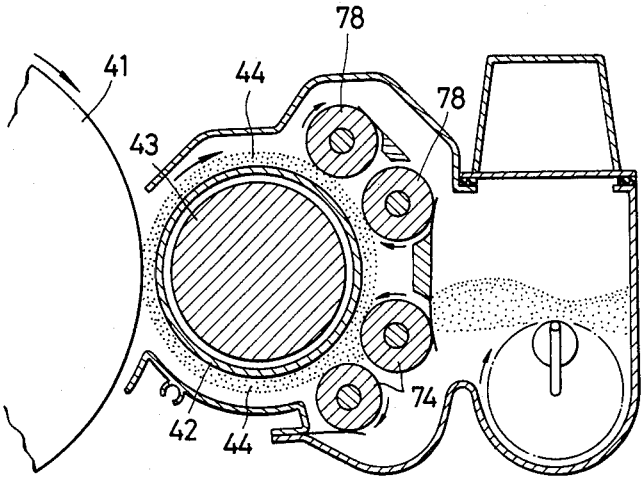

In FIG. 4 which shows still another embodiment, two toner recovery rollers 78 and two toner supply rollers 74 are disposed around the magnetic brush 14, the toner recovery rollers 78 being located upstream of the toner supply rollers 74 in the direction of rotation of the magnetic brush 44. The two toner recovery rollers 78 and the two toner supply rollers 74 are effective in sufficiently recovering and supplying toner. Images can therefore be developed stably without a reduction in density and image deterioration even when the magnetic brush 44 is rotated at an increased speed for high-speed copying and printing.

Figure 5:
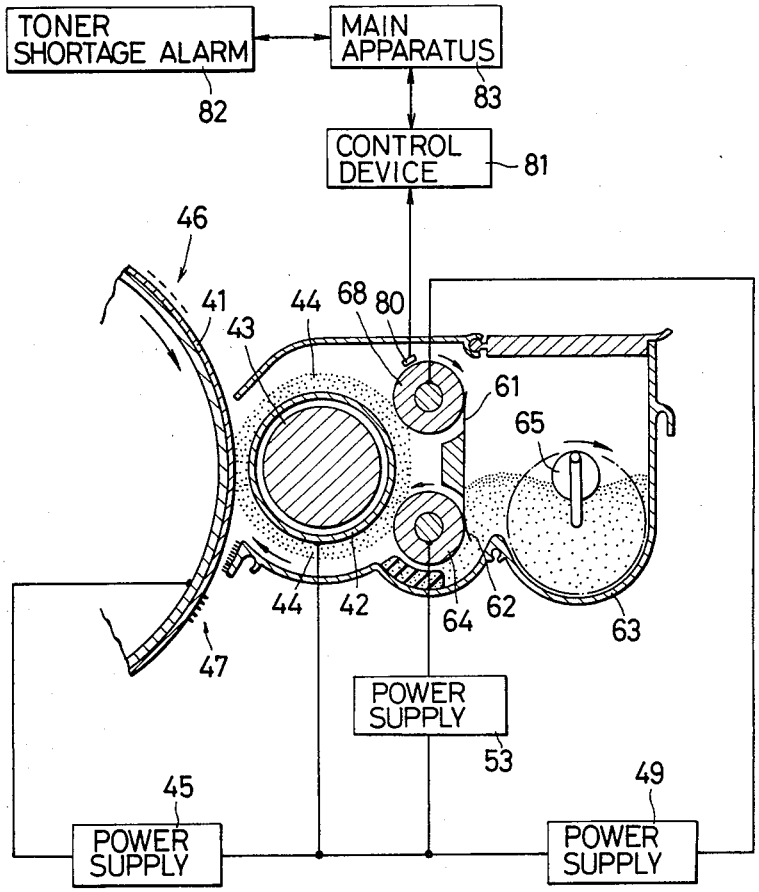
Figure 6:
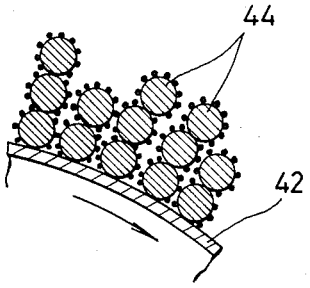
FIG. 6 is an enlarged fragmentary view of a magnetic brush.

An image developing apparatus according to a further embodiment of the present invention illustrated in FIG. 5 has a nonmagnetic development sleeve 42 made of aluminum or the like and disposed near a photosensitive body 41. The development sleeve 42 houses a permanent magnet 43 having a plurality of magnetic poles for producing magnetic forces to form a magnetic brush 44 composed of a magnetic carrier and toner on the surface of the development sleeve 42 (see FIG. 6). The magnetic brush 44 is rotated in the direction of the arrow by rotation of at least one of the development sleeve 42 and the permanent magnet 43.

A bias voltage is applied by a power supply circuit 45 to the development sleeve 42 and the photosensitive body 41.

Toner is supplied to the magnetic brush 44 on the development sleeve 42 by a toner supply roller 64 serving as a toner supply means disposed in a toner supplying region. The magnetic brush 44 is moved in the direction of the arrow B into contact with the photosensitive body 41 to develop an electrostatic latent image 46 thereon into a visible image in an image developing region located downstream of the toner supplying region.

A toner recovery roller 68 is disposed as a toner recovery means in a toner recovering region located downstream of the image developing region around the development sleeve 42.

After image development, the magnetic brush 44 contrinues to rotate into the toner recovering region in which toner in the magnetic brush 44 is transferred to the toner recovery roller 68 under a bias voltage applied by a toner recovery power supply circuit 49 coupled to the toner recovery roller 68. The toner that has been delivered to the toner recovery roller 68 is scraped off into a toner tank 63 by a blade 63 pressed against the toner recover roller 68 as it is rotated in the direction of the arrow C.

Since electrostatic latent images on the photosensitive body 41 are developed by repeatedly supplying toner to and recovering toner from the magnetic brush 44, the density distribution of the toner which contributes to the image development is rendered constant at all times. As a consequence, toner density differences (toner density irregularities) caused by developing images are eliminated, so that the developed images are stable in quality.

The magnetic brush 44 that has passed through the toner recovery region is supplied with new toner by the toner supply roller 64 in the toner supplying region for developing a next image on the photosensitive body 41.

A toner layer limiting blade 62 is disposed in contact with the peripheral surface of the toner supply roller 64. Upon rotation of the toner supply roller 64 in the direction of the arrow D, the toner in the toner tank 63 is charged and supplied as a thin layer on the surface of the toner supply roller 64 by the toner layer limiting blade 62. The toner supply roller 64 is connected to a toner supply power supply circuit 53 which applies a bias voltage to supply the toner from the toner supply roller 64 to the magnetic brush 44 for image development.

An agitator 65 is disposed in the toner tank 63 for prevent toner blocking which tends to be caused when a large amount of toner is supplied to the toner tank 63. The agitator 65 is also effective to deliver toner to the toner supply roller 64 for increasing the stability of a developed image.

The toner recovery roller 68 is associated with a detector means 80 for detecting the amount of toner recovered from the magnetic brush 44. The detector means 80 comprises a sensor having a light source (LED) for applying light to the toner recovered by the toner recovery roller 68 and a light detector (CDS) for detecting light emitted from the light source and passed through the recovered toner. The recovered amount of toner can be detected by the detector means 80 since the amount of light that has passed through the recovered toner varies dependent on the amount of toner (toner density) recovered on the toner recovery roller 68. The detector means 80 produces a toner amount signal which is applied as a toner shortage signal to a control device 81.

More specifically, when the amount of toner stored in the toner tank 63 is reduced, the amount of toner supplied from the toner supply roller 64 to the magnetic brush 44 is also reduced. Upon a reduction in the amount of toner in the magnetic brush 44, the amount of toner recoverd by the toner recovery roller 68 is reduced. Therefore, the amount of toner remaining in the toner tank 63 can be detected by detecting the recovered amount of toner (toner density).

The control device 81 ascertains whether there is toner in the toner tank 63 based on the toner signal from the detector means 80. If toner is not present in the toner tank 63 (upon toner shortage), then the control device 81 applies a toner shortage signal to a toner shortage alarm 82 such as a lamp or a buzzer, and also to a main apparatus 83 such as a copying machine or a printer in which the image developing apparatus is incorporated.

Figure 7:
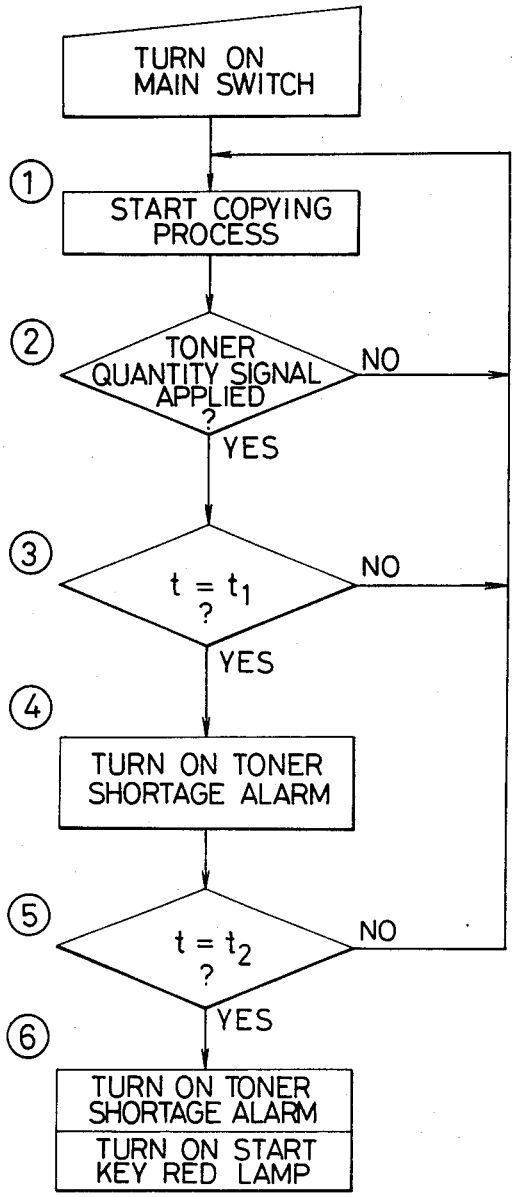
FIG. 7 is a flowchart of a toner shortage detecting sequence.
Figure 8:
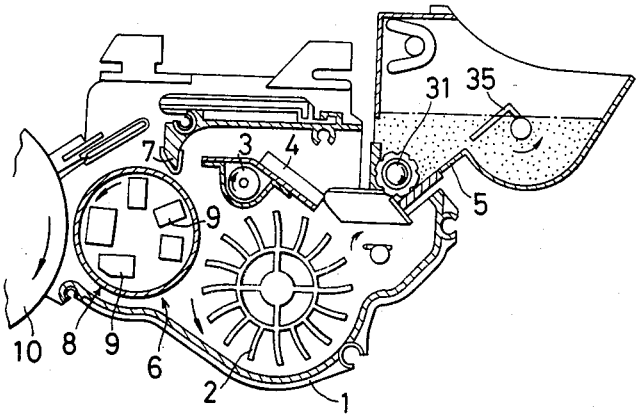
FIG. 8 (PRIOR ART)
FIG. 8 is a vertical cross-sectional view of a general image developing apparatus.
Figure 9:
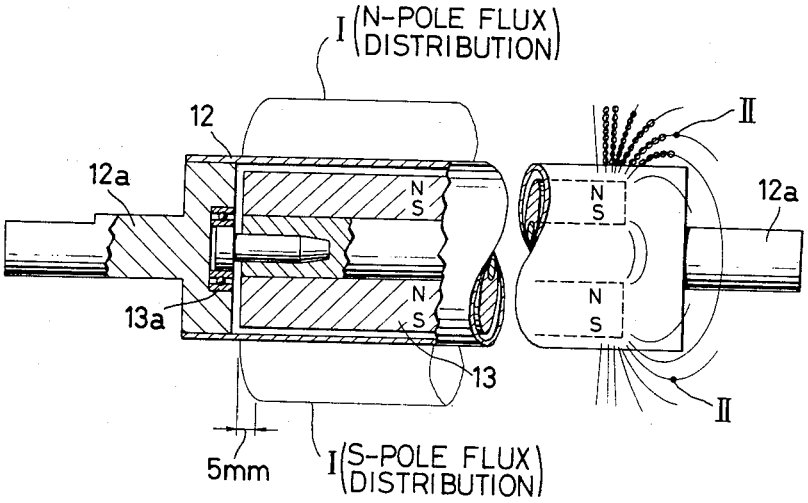
FIG. 9 (PRIOR ART)
FIG. 9 is a fragmentary longitudinal cross-sectional view of a development sleeve in the general image developing apparatus.
Figure 10:
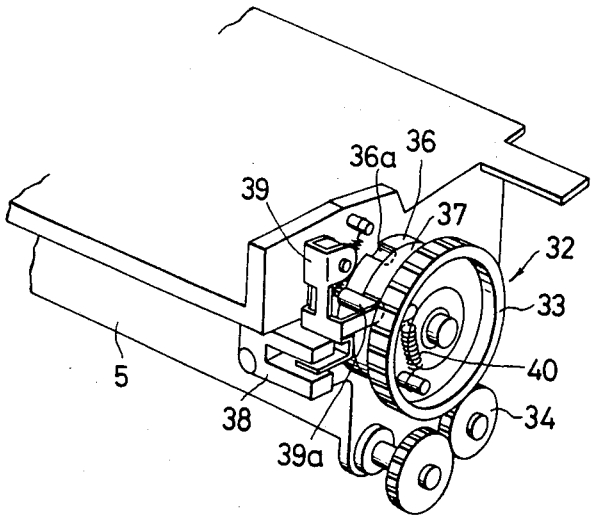
FIG. 10 (PRIOR ART)
FIG. 10 is a perspective view of a toner supply driver mechanism.
Figure 11A:
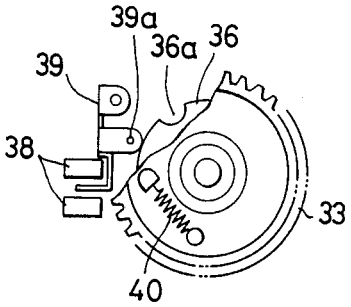
FIG. 11(a) PRIOR ART
FIGS. 11(*a*) and 11(*b*) are fragmentary side and front elevational views of the toner supply driver mechanism, showing one operating position.
Figure 11B:
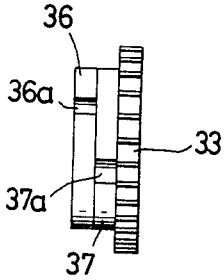
FIG. 11(b) PRIOR ART
Figure 12A:
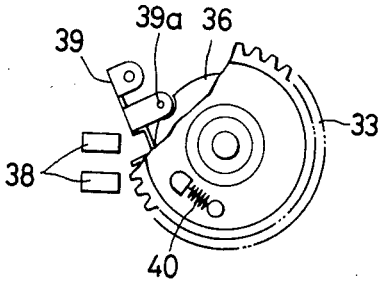
FIG. 12(a) PRIOR ART
FIGS. 12(*a*) and 12(*b*) are fragmentary side and front elevational views of the toner supply driver mechanism, showing another operating position.
Figure 12B:
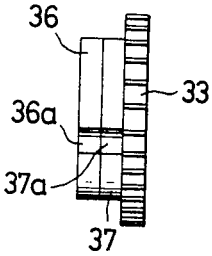
FIG. 12(b) PRIOR ART

When the control device 81 is supplied with an ON signal from a main switch of the main apparatus 83, the control device 81 operates according to a program or operation sequence as shown in FIG. 7 written in a ROM in the control device 81.

When the main switch is turned on in FIG. 7, the main apparatus 81 operates in a known copying process to produce a copy in a step 1.

A next step 2 ascertains whether there is an input signal from the detector means 80. If there is no recovered toner or there is nearly no recovered toner, an input is applied from the detector means 80 in the step 2. If there is a sufficient amount of toner in the toner tank 63, no input is applied from the detector means 80, and control returns to the step 1 in which the main apparatus 83 can start a copying cycle. If the toner tank 63 runs short of toner, and an input is applied from the detector means 80 in the step 2, then control proceeds to a step 3.

The step 3 ascertains whether the toner signal from the detector means 80 is continuously applied for a first prescribed time t1. The first prescribed time t1 is set to a time period required after toner has been recovered in a previous developing cycle and until toner is recovered in a next developing cycle. For example, the first prescribed time t1 is set to a time period long enough to prevent erroneous detection by the detector means 80 which would arise from a reduction of the amount of recovered toner when the electrostatic image of an original demanding large toner consumption, such as a fully black original, is developed. If the time period t for which the toner signal is issued is shorter than the first prescribed time t1 in the step 3, i.e., if sufficient toner is available, then control goes back to the step 1. If the time period t for which the toner signal is issued reaches the first prescribed time t1 in the step 3 (i.e., if toner shortage occurs), then the toner shortage alarm 82 is energized to flicker a toner shortage lamp, for example. When the toner shortage alarm 82 is operated, then a step 5 ascertains whether the time period t is continuously applied until it reaches a second prescribed time t2, which is longer than the first prescribed time t1 ($t2>t1$). If $t\neq t2$ in the step 5, i.e., if the toner tank 63 runs short of toner, or if the step 4 is executed after image development requiring a large amount of toner consumption has continued for more than the first prescribed time t1 but the time period t does not reach the second prescribed time t2, then control returns to the step 1 for copying operation. If $t=t2$ in the step 5, then a step 6 is executed to energize the toner shortage alarm 82 and a means for inhibiting copying operation of the main apparatus 83 (such as a start key red lamp).

The above toner shortage detecting operation is executed not only when the toner hopper 63 is completely short of toner, but also when no toner is supplied to the image developing region as when the amount of carrier particles is reduced below a certain level.

As described above, the toner shortage alarm 82 is operated while distinguishing a reduction in the amount of recovered toner due to toner shortage and a reduction in the amount of recovered toner due to development of an electrostatic latent image from each other. Therefore, the detector means 80 is prevented from erroneous operation. Moreover, a reduction in the image quality which would be caused on toner shortage can be prevented, and the toner supply roller 64 and the toner layer limiting blade 62 are prevented from being damaged or broken.

In each of the above embodiments, the sleeve is shown as cylindrical. However, a belt-like sleeve may also be employed.

In the embodiment shown in FIG. 5, the magnetic brush may be replaced with a fiber brush, and toner can be supplied to, delivered by, applied for image development by, and recovered from such a fiber brush in the same manner as described above. The fiber brush may for example be composed of a roller with its peripheral surface electrostatically flocked with fibers each in the form of a nylon yarn, about 1 mm long and about 20 micrometers thick, at a density of about 30 thousand yarns/square inches.

Although certain preferred embodiments have been shown and described, it should be understood that many changes and modifications may be made therein without departing from the scope of the appended claims.

We claim:

1. An apparatus for developing an electrostatic latent image, comprising:

a magnetic brush for holding toner and resiliently contacting a latent image carrier in an image developing region to supply the toner to an electrostatic latent image formed on the latent image carrier;

toner supply means for supplying charged toner to said magnetic brush in a toner supplying region;

toner recovery means for recovering residual toner from said magnetic brush in a toner recovering region after the image has been developed by the toner; and said magnetic brush being composed of a magnetically coherent carrier of particles.

2. An apparatus for developing an electrostatic latent image, comprising:

resilient developing brush means for holding toner and resiliently contacting a latent image carrier in an image developing region to supply the toner to an electrostatic latent image formed on the latent image carrier;

toner supply means for supplying charged toner to said resilient developing brush means in a toner supplying region;

toner recovery means for recovering residual toner from said resilient developing brush means in a toner recovering region after the image has been developed by the toner;

detector means for detecting the amount of toner recovered by said toner recovery means to issue a toner signal; and toner shortage detecting means for detecting a toner shortage in a toner tank to issue a toner shortage signal based on the toner signal from said detector means.

3. An apparatus according to claim 2, wherein said resilient developing brush means comprises a magnetic brush disposed on a sleeve and having brush fibers formed by a magnetic field.

4. An apparatus according to claim 2, wherein said resilient developing brush means comprises a fiber brush composed of fibers on a roller.

5. An apparatus according to claim 2, further including toner shortage alarm means for issuing a toner shortage alarm signal, a main apparatus for effecting copying operation, and a control device for energizing said toner shortage alarm means when the toner shortage signal from said toner shortage detecting means continues for a first prescribed time, and for inhibiting the copying operation of said main apparatus when said toner shortage signal continues for a second prescribed time longer than said first prescribed time.

* * * * *